US005820416A

United States Patent [19]

Carmichael

[11] Patent Number: 5,820,416

[45] Date of Patent: Oct. 13, 1998

[54] MULTIPLE CONTACT WET CONNECTOR

[76] Inventor: Alan L. Carmichael, P.O. Box 1535, Spring, Tex. 77383-1535

[21] Appl. No.: 778,505

[22] Filed: Jan. 3, 1997

[51] Int. Cl.[6] ..... H01R 17/18

[52] U.S. Cl. ..... 439/668; 439/190; 166/65.1

[58] Field of Search ..... 439/190, 668, 439/199, 271.7, 700; 166/65.1

[56] References Cited

U.S. PATENT DOCUMENTS

| | | |
|---|---|---|
| 4,105,279 | 8/1978 | Glotin et al. . |
| 4,438,996 | 3/1984 | Zehren . |
| 4,553,807 | 11/1985 | Cane . |
| 4,588,243 | 5/1986 | Ramsey et al. . |
| 4,660,910 | 4/1987 | Sharp et al. . |
| 4,690,212 | 9/1987 | Termohlen . |
| 4,759,406 | 7/1988 | Smith et al. . |
| 4,767,349 | 8/1988 | Pottier et al. . |
| 4,781,607 | 11/1988 | Rumbaugh . |
| 4,997,384 | 3/1991 | Godfrey et al. . |
| 5,052,941 | 10/1991 | Hernandez-Marti et al. . |
| 5,131,464 | 7/1992 | Lenhart et al. . |
| 5,141,051 | 8/1992 | Lenhart . |
| 5,171,158 | 12/1992 | Cairns ..... 439/190 |
| 5,358,418 | 10/1994 | Carmichael . |
| 5,389,003 | 2/1995 | Van Steenmyk et al. . |

*Primary Examiner*—Kheim Nguyen
*Assistant Examiner*—Eugene G. Byrd
*Attorney, Agent, or Firm*—Keeling Law Firm

[57] ABSTRACT

A multiple contact wet connector that includes a male connector assembly having a nose portion that removably fits within an axial cavity in a female connector assembly. The connector assemblies are constructed for attachment to equipment and instrumentation in a wet environment. Each of the connector assemblies include a plurality of conductors that are constructed for attachment to conductors in the equipment and instrumentation. Each conductor in the male connector assembly is matched with a conductor in the female connector assembly for transmission of a signal therethrough. Electrical contacts within the connector assemblies provide individual contact of the matching conductors. Insulators separate and insulate the electrical contacts from one another. Seals between the contacts isolate the fluid near one contact from the fluid near the other contacts. Thereby, the seals further insulate the contacts from one another.

26 Claims, 11 Drawing Sheets

MULTIPLE CONTACT WET CONNECTOR

This application claims the benefit of U.S. Provisional Application Number 60/009,589 filed by Carmichael on Jan. 4, 1996.

BACKGROUND OF THE INVENTION

Field of Invention

This invention relates to an electrical connector. More specifically, it is directed to a releasable electrical connector having multiple individual contacts that provides electrical contact in a wet environment. The invention is functional in any wet environment, including the downhole and subsea/underwater environments.

A number of electrical tools are used within wet environments. Examples of such tools in the downhole environment are logging systems and measuring while drilling devices. These wet environment tools require electrical connection between each other and sometimes to surface equipment in order to transmit and receive signals and power therebetween. Wet environment connections are also required for subsea applications, including communications cables. U.S. Pat. No. 5,358,418 and U.S. Pat. No. 4,588,243 discuss examples of such applications in the downhole environment.

From time to time it is desirable or necessary to connect, disconnect, or reconnect the wet environment instruments and equipment. For example, to replace or add electrical equipment, the instruments must be disconnected. Therefore, a releasable connector is desirable to complete these tasks without having to remove the equipment and instruments from the wet environment.

The instruments are surrounded by electrically conductive substances (i.e. water in the subsea environment, and drilling mud in the downhole environment) and therefore, operate in a wet environment. Consequently, the electrical connectors must be sealed and insulated to prevent interference with the instrumentation signals.

Many wet environment instruments contain a multitude of individual instruments. Each of these instruments must individually communicate with the surface equipment or other downhole equipment. Accordingly, each of the instruments preferably utilizes its own communication wire that, in turn, requires a separate connector. Heretofore, releasable downhole connectors have not provided for multiple contacts.

This invention may also be used in situations where electrical connections must be made in subsea or underwater environments. Using the invention, instruments and equipment may be connected, disconnected, or reconnected to each other in the subsea environment or to other instruments and equipment on the surface of the water (in a dry environment) without removing the underwater equipment from the wet environment.

Related Art

Releasable electrical wet connects are known to the prior art. Illustrative of such devices are U.S. Pat. No. 4,588,243, U.S. Pat. No. 5,131,464, and U.S. Pat. No. 5,358,418. None of these devices, however, provide for separate transmission of a plurality of signals simultaneously; nor do they provide multiple connectors for a plurality of separate transmission conductors.

SUMMARY OF THE INVENTION

Accordingly, the objectives of this invention are to provide, inter alia, a multiple contact wet connector that:

- provides releasable connection in a downhole environment;
- provides releasable connection in a subsea or underwater environment;
- provides releasable connection in a wet environment;
- provides insulated, electrical contact in a wet environment;
- incorporates multiple, individually insulated contacts that facilitate separate connection of multiple transmission conductors;
- allows the simultaneous transmission of a plurality of signals from instrumentation in a wet environment to each other or to surface equipment;
- provides for self-centering and longitudinal alignment;
- may be easily adapted for incorporation in a variety of drill strings and for a variety of instruments within the downhole environment;
- is easily modified to provide for differing numbers of contacts or required lengths; and
- is durable, easily implemented, and inexpensive to manufacture.

Other objects of the invention will become apparent from time to time throughout the specification and claims as hereinafter related.

To achieve such improvements, my invention is a multiple contact wet connect that includes a male connector assembly that has a nose portion constructed for releasable insertion into a female connector assembly. The male connector is removably mountable to a first set of instrumentation in the wet environment and includes conductor attachments for electrical connection to the first set of instruments. Likewise, the female connector is removably mountable to a second set of instrumentation in the wet environment and includes conductor attachments for electrical connection to the second set of instruments. A plurality of conductors for transmission of the electrical signals extend through the male connector assembly; and a plurality of matching conductors for transmission of the electrical signals extend through the female connector assembly. Each conductor in the male connector assembly matches a conductor in the female connector assembly to form conductor pairs. A plurality of contact means provide electrical contact between the matching conductor pairs. Thereby, each matching conductor pair and the associated contact facilitates the transmission of an electrical signal or power between the first and second set of instruments in the wet environment and, if applicable, the equipment at the surface or dry environment. An insulation means separates and insulates the contacts from each other and the surrounding environment.

BRIEF DESCRIPTION OF THE DRAWING

The manner in which these objectives and other desirable characteristics can be obtained is explained in the following description and attached drawings in which.

DETAILED DESCRIPTION OF THE INVENTION

The preferred embodiment of my invention is illustrated in FIGS. 1 through 12 and the multiple contact wet connector is depicted as 10.

Figure 1:
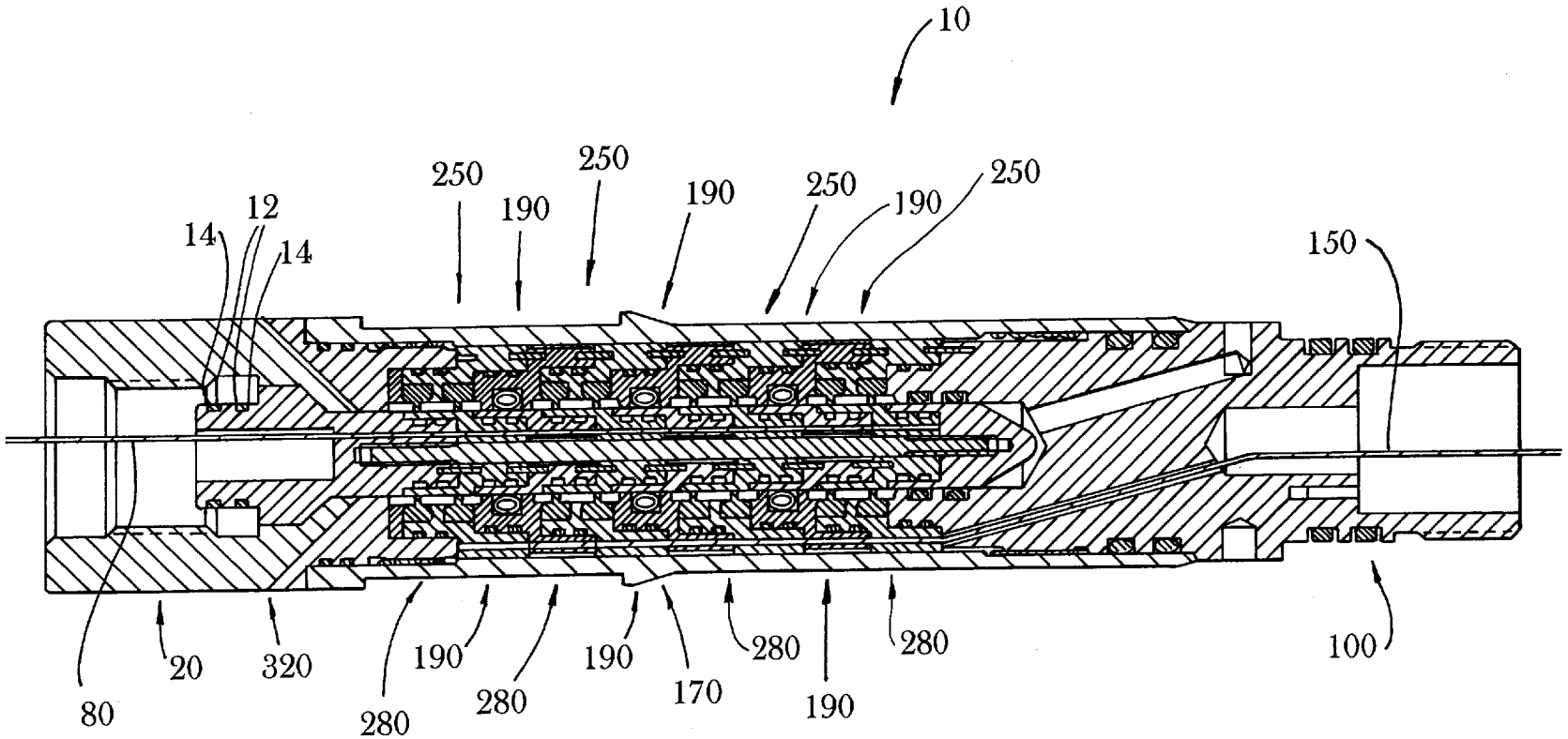
FIG. 1 is a cross sectional view of the multiple contact wet connector.
Figure 2:
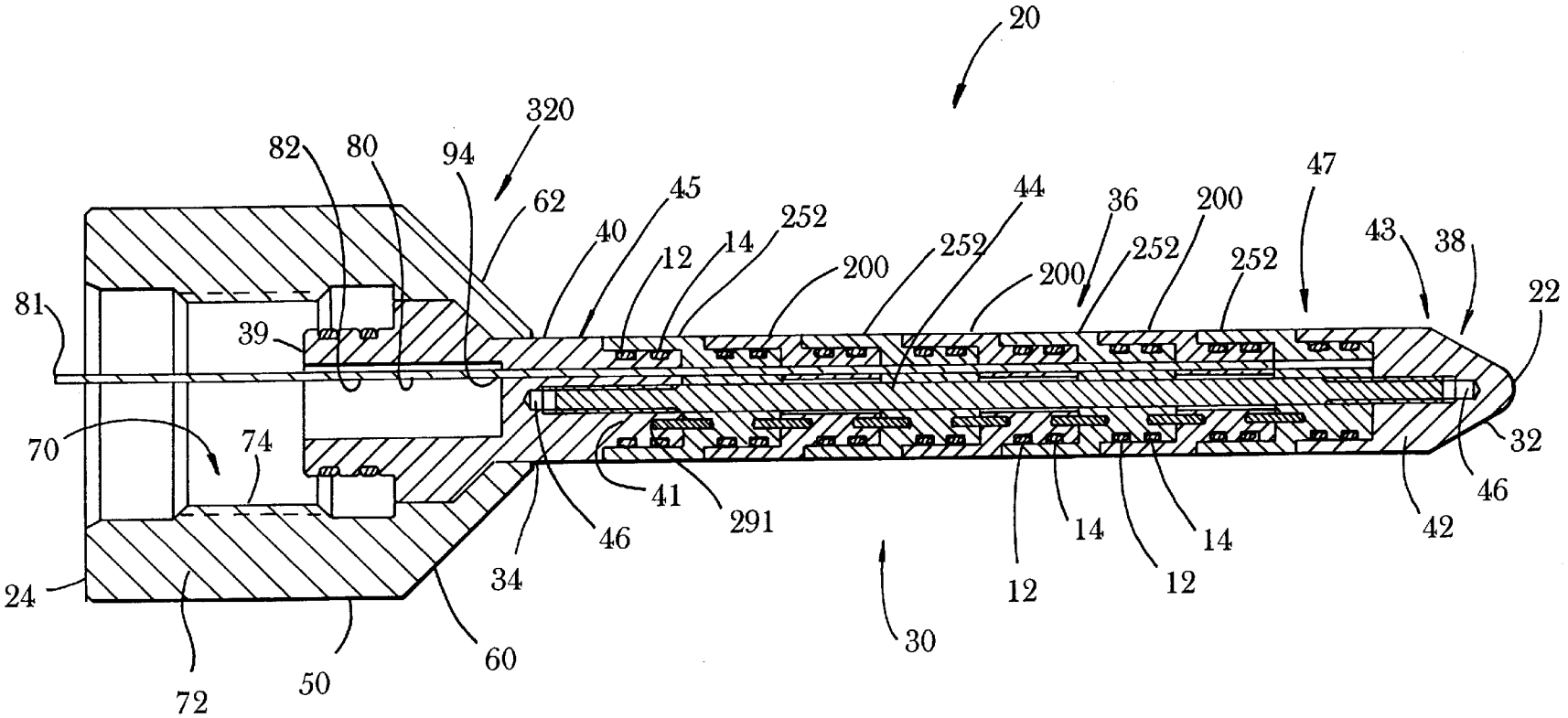
FIG. 2 is a cross sectional view of the male connector assembly.
Figure 3:
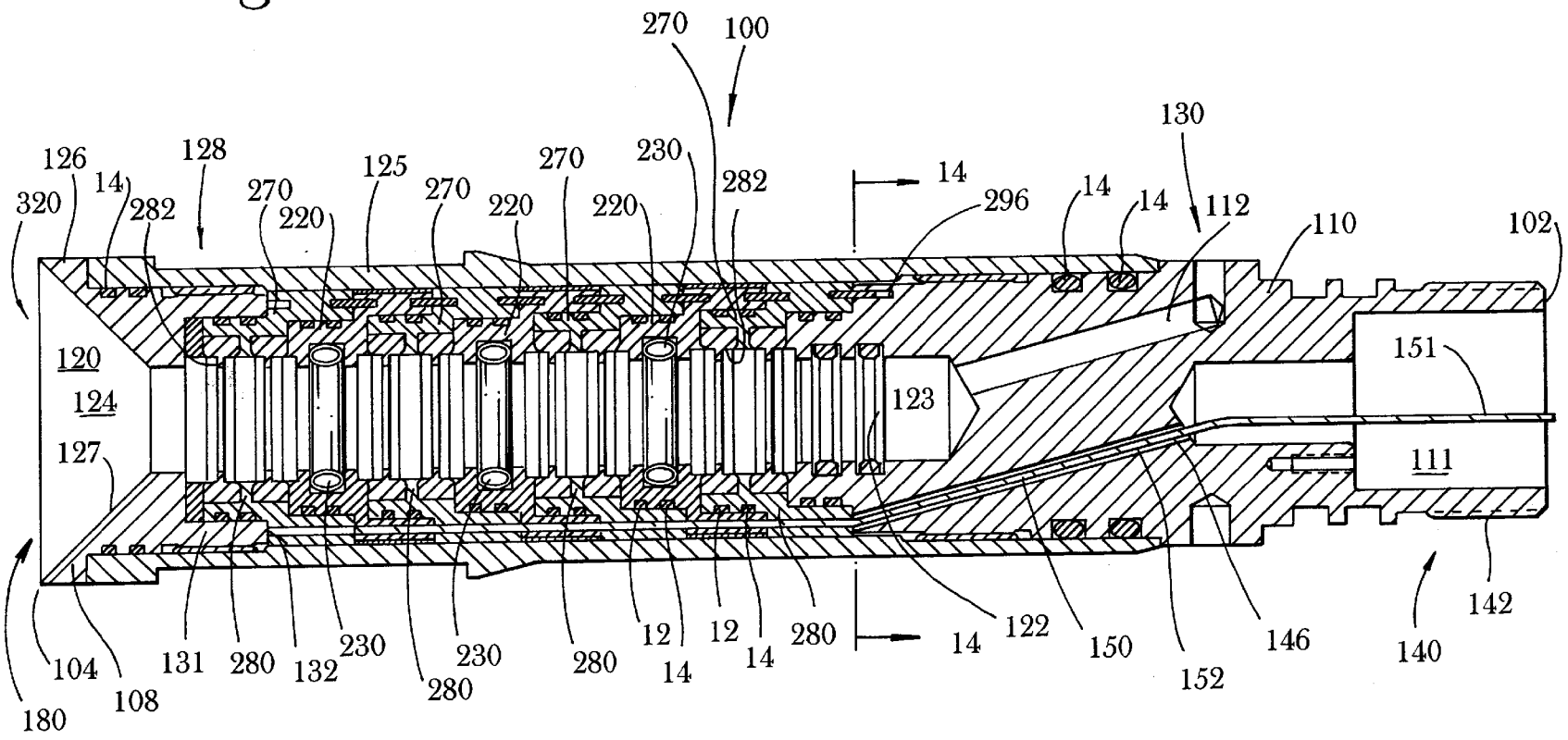
FIG. 3 is a cross sectional view of the female connector assembly.

The multiple contact wet connector 10 includes a male connector assembly 20 and a female connector assembly 100 constructed for releasable attachment to one another. FIG. 1 depicts a cross-section of male connector assembly 20 and female connector assembly 100 attached to each other in an assembled position. FIG. 2 depicts a cross-section of male connector assembly 20 by itself. FIG. 3 depicts a cross-section of female connector assembly 100 by itself.

The male connector assembly 20 includes male conductor means 80 (best seen on FIG. 2). The female connector assembly 100 includes female conductor means 150 (best shown on FIG. 3). Conductor means 80 and 150 provide electrical communication through male connector assembly 20 and female connector assembly 150 respectively.

Referring to FIG. 1, a plurality of contact means 190 within the multiple contact wet connector 10 provides for electrical contact between the male conductor means 80 and the female conductor means 150 when the multiple contact wet connector 10 is functionally assembled. Because the multiple contact wet connector 10 operates in a wet environment, the separate contact means 190 and conductor means, 80 and 150, are isolated from the others with insulation means 250. One preferred embodiment, shown in the drawings, discloses a multiple contact wet connector 10 having three contact means 190.

Referring to FIG. 2, the male connector assembly 20 has a first male end 22 and a second male end 24. A male connecting portion 50 that is proximal the second male end 24 includes a male connector attachment means 70 that provides releasable attachment of the male connector assembly 20 to adjacent instruments in the wet environment or to other equipment positioned in a dry environment. These instruments and equipment so positioned are hereinafter referred to as first set of wet environment equipment. Although the male connector attachment means 70 may take any number of a variety of forms, it is preferably a sleeve 72 having internal cooperative threading 74 constructed to mate with external threading on the first set of wet environment equipment. Preferably, when used within a well bore, the male connector assembly 20 mounts in the well bore, in electronic equipment, with its second male end 24 relatively near the well bore bottom, proximal the electronic equipment, and the first male end 22 relatively near the surface.

The portion of the male connecting portion 50 distal to second male end 24 is a frustoconical male engagement portion 60. The outer diameter of the frustoconical male engagement portion 60 increases in the direction of second male end 24 and, thereby, defines an inclined surface 62.

A nose portion 30 connects to the male connecting portion 50 at its second nose end 34 and extends to the first male end 22, which coincides with the first nose end 32. Along its length, the nose portion 30 primarily consists of an elongated, substantially cylindrical central nose portion 36 that has a diameter less than or equal to the smallest diameter of the frustoconical male engagement portion 60. Extending from the central nose portion 36 to the first male end 22, a conical portion 38 has a diameter that decreases in the direction of first male end 22. At the plane of intersection of the conical portion 38 and the central nose portion 36, their diameters are preferably, substantially equal.

Figure 11:
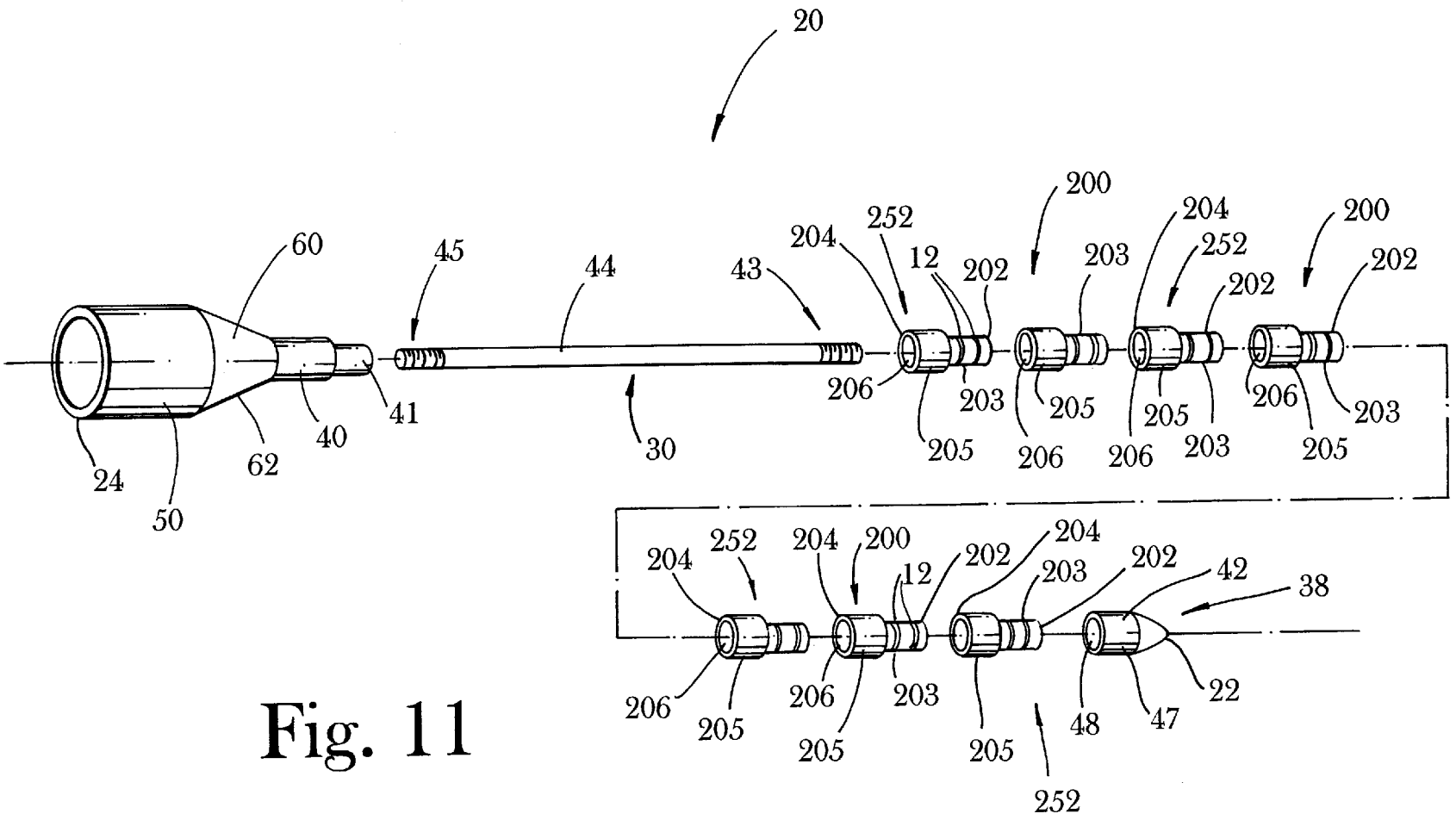
FIG. 11 is an exploded, isometric view of the male connector assembly.

As shown in FIG. 2 and in FIG. 11, the nose portion 30 is formed of (1) an extension body 40, (2) a plurality of alternating male electrical contacts 200 and male insulation members 252, and (3) a nose cone 42. As seen in FIG. 11, a central connecting rod 44 holds the nose portion 30 parts together. The extension body 40 attaches to the male connecting portion 50 and provides an extension therefrom. Preferably, the extension body 40 is constructed of a nonconductive material. At the end of the extension body 40 distal to second male end 24, a first rod connecting means 45 provides connection of the central connecting rod 44 and the extension body 40. Typically, the first rod connecting means 45 is an axial threaded bore 46 extending into the extension body 40 constructed to receive and mate with cooperating threading on the first rod connecting means 45. Additionally, as best shown in FIG. 11, extension body 40 includes a portion 41 which is distal to second male end 24. Portion 41 has a reduced diameter constructed for interlocking receipt of a mating male electrical contact 200. Portion 41 is similar in size and shape to a male insertion portion 203 as described below. As best shown in FIG. 2, portion 41 includes o-ring grooves 12 fitted with o-rings 14 that provide a seal between the parts. Preferably, portion 41 includes two o-ring grooves 12 and o-rings 14.

The male electrical contacts 200 are formed of a conductive material, such as stainless steel; and the male insulation members 252 are formed of a nonconductive material, such as a high temperature plastic. However, the male electrical contacts 200 and the male insulation members 252 (referred to generically as male sleeves) preferably have a substantially similar size and shape and are constructed for alternating interlocking attachment. Thus, although FIG. 4 shows the cross-section of a male electrical contact 200, it is understood that the cross-section of a male insulation member 252 is substantially similar.

Figure 4:
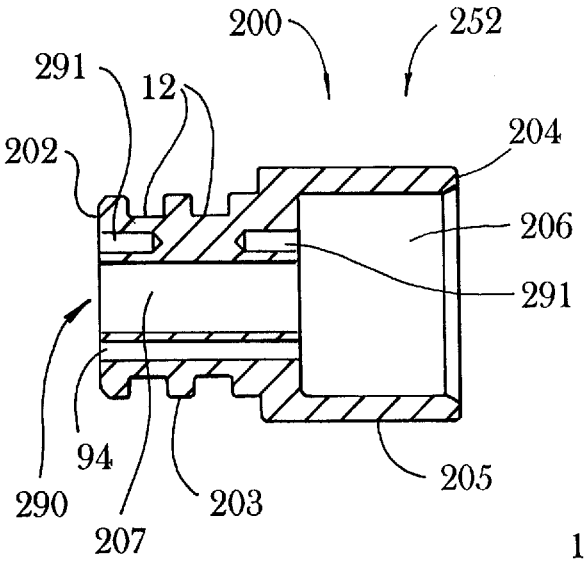
FIG. 4 is a cross sectional view of a male sleeve.
Figure 5:
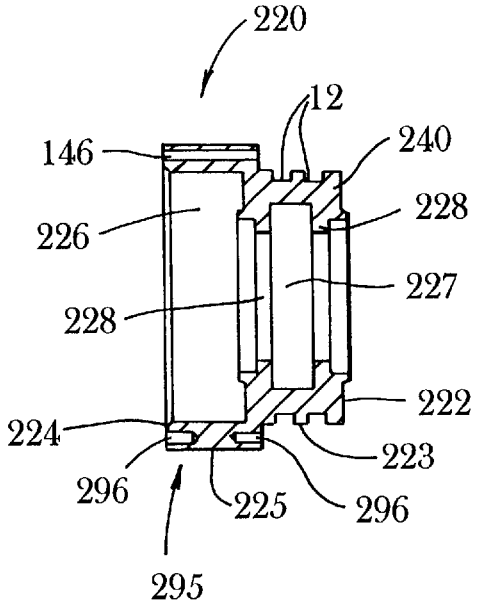
FIG. 5 is a cross sectional view of a female electrical contact.

Referring to FIGS. 4 and 11, the male sleeves, 200 and 252, have a male insertion portion 203 at their male insertion end 202 and a male receiving portion 205 at their male receiving end 204. A male receiving cavity 206 extends axially from the male receiving end 204 partially into the male receiving portion 205. The male receiving portion 205 is substantially cylindrical and has an outer diameter that corresponds to the diameter of the nose portion 30. The male insertion portion 203 is substantially cylindrical and has an outer diameter that is less than the outer diameter of the male receiving portion 205. To provide for interlocking attachment of the male sleeves, 200 and 252, the male receiving cavity 206 has a diameter that is slightly greater than the outer diameter of the male insertion portion 203 and is constructed for receipt of the male insertion portion 203. For proper abutment of adjacent male sleeves, 200 and 252, the male receiving cavity 206 has an axial length that is greater than the axial length of the male insertion portion 203. In this way, when the adjacent male sleeves, 200 and 252, are positioned in interlocking abutment their male receiving portions 205 form a continuous substantially cylindrical outer surface. Additionally, the male insertion portion 203 includes at least one o-ring groove 12 with an o-ring 14 therein. As best seen in FIG. 2, the o-rings 14 mate with the male receiving cavity 206 to provide a seal between the adjacent male sleeves, 200 and 252. Preferably, each male insertion portion 203 has two o-ring grooves 12.

Each of the male sleeves, 200 and 252, also includes an axial bore 207 therethrough that is sized to allow placement of the central connecting rod 44 therethrough.

As shown in FIGS. 2 and 11, the nose cone 42 includes the conical portion 38 of the nose portion 30 previously described. Additionally, the nose cone 42 includes a receiving portion 47 that defines a receiving cavity 48 and is similar to the male receiving portion 205 of the male sleeves, 200 and 252. In other words, the receiving portion 47 has an outer diameter equal to the outer diameter of the male receiving portion 205 of the male sleeves, 200 and 252. Likewise, the receiving cavity 48 is sized and constructed to receive a male insertion portion 203 of the male sleeves, 200 and 252 as described above. In addition, however, the nose cone 42 includes a second rod connecting means 43 that provides connection of the central connecting rod 44 and the nose cone 42. Typically, the second rod connecting means 43 is an axial threaded bore 46 extending into the nose cone 42 constructed to receive and mate with cooperating threading on the second rod connecting means 43.

When assembled, the extension body 40 connects to the male connecting portion 50; and the central connecting rod 44 threadedly connects to the axial threaded bore 46. A male electrical contact 200 fits over the central connecting rod 44 and into interlocking abutment with the portion 41 of the extension body 40. Alternatively, a male insulation member 252 mates with the portion 41 and the male electrical contact 200 mates with a male insulation member 252. A male insulation member 252 similarly fits over the central connecting rod 44 and into interlocking abutment with the male insertion portion 203 of the previously installed male electrical contact 200. Additional, alternating male electrical contacts 200 and male insulation members 252 are then similarly installed. To provide for proper insulation of the male electrical contacts 200, a male insulation member 252 must separate the male electrical contacts 200. Finally, the nose cone 42 threadedly connects to the central connecting rod 44 and, thereby, maintains the male sleeves, 200 and 252, on the central connecting rod 44. Because of the modular design of the male connector assembly 20, the number of male sleeves, 200 and 252, their specific arrangement, and the length of the male connector assembly 20 are easily changed.

Figure 8:
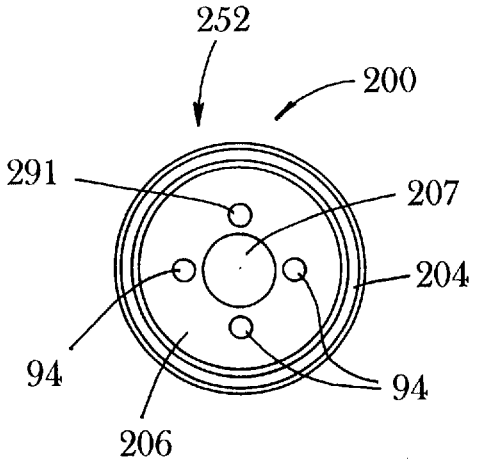
FIG. 8 is an isometric view of a male sleeve.

As shown in FIGS. 2, 4, and 8, each of the male sleeves, 200 and 252, and the extension body 40 include a plurality of male wiring passageways 94 that extend parallel to the axis of the male connector assembly 20. The male wiring passageways 94 are positioned so that, when the male connector assembly 20 is assembled, the male wiring passageways 94 in each of male sleeves 200 and 252 and extension body 40 are aligned. Each of the male wiring passageways 94 is sized to permit the placement of a conductor means 80 therethrough. Preferably, the number of male wiring passageways 94 equals the number of male electrical contacts 200 in the male connector assembly 20.

Figure 9:
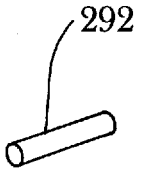
FIG. 9 is an isometric view of a male alignment pin.

As shown in FIGS. 2, 4, and 8, a separate male alignment passageway 291 extends parallel to the axis of the male connector assembly 20 through each of the male sleeves, 200 and 252, and the extension body 40. When the male connector assembly 20 is assembled, the male alignment passageways 291 in the individual parts are aligned. One or more male alignment pins 292, as shown in FIG. 9, are sized and constructed to fit into the male alignment passageway 291 so that, when inserted, the male alignment pins 292 prevent the relative rotation of the male sleeves, 200 and 252, and the extension body 40. Consequently, the male alignment passageways 291 and the male alignment pins 292 comprise a male sleeve alignment means 290. Alternatively, the male sleeve alignment means 290 may comprise a plurality of coaxial male alignment passageways 291 wherein each male alignment passageway 291 extends partly into each of the adjacent male sleeves, 200 and 252. The length of each such male alignment passageway 291 is sufficient to receive a single male alignment pin 292 therein. Many possible designs for male sleeve alignment means 290 are anticipated. However, the male sleeve alignment means 290 described are preferred.

Within the male connecting assembly 20, a plurality of male conductor means 80 provide conductive electrical communication through the male connector assembly 20. The number of male conductor means 80 preferably corresponds to the number of male electrical contacts 200 and to the number required for the pertinent application. Each male conductor means 80 connects to a separate male electrical contact 200 and extends from that contact, through its associated male wiring passageway 94, to the first end 39 of extension body 40 distal to portion 41. As shown in FIG. 8, each male conductor means 80 extends through the male sleeves, 200 and 252, within a separate male wiring passageway 94. Preferably, the male conductor means 80 is an insulated elongated member 82 constructed of a conductive material such as a high temperature wire or contact pins.

At the end of the male conductor means 80 distal the male electrical contact 200, the male attachment end 81, a male conductor attachment means (not shown in Figures) provides for releasable attachment of and conductive communication between the male conductor means 80 and the first set of wet environment equipment conductor means (not shown in Figures). The configuration and shape of the male conductor attachment means may take many forms and will depend on the equipment to which the male conductor means is attached. One example, not shown in the figures, is simply a cylindrical body, having an axial wire receiving bore therein, in electrical communication with the male attachment end 81. The end of the first set of wet environment equipment conductor means would simply slide into the axial wire receiving bore and make conductive contact therewith.

Figure 12:
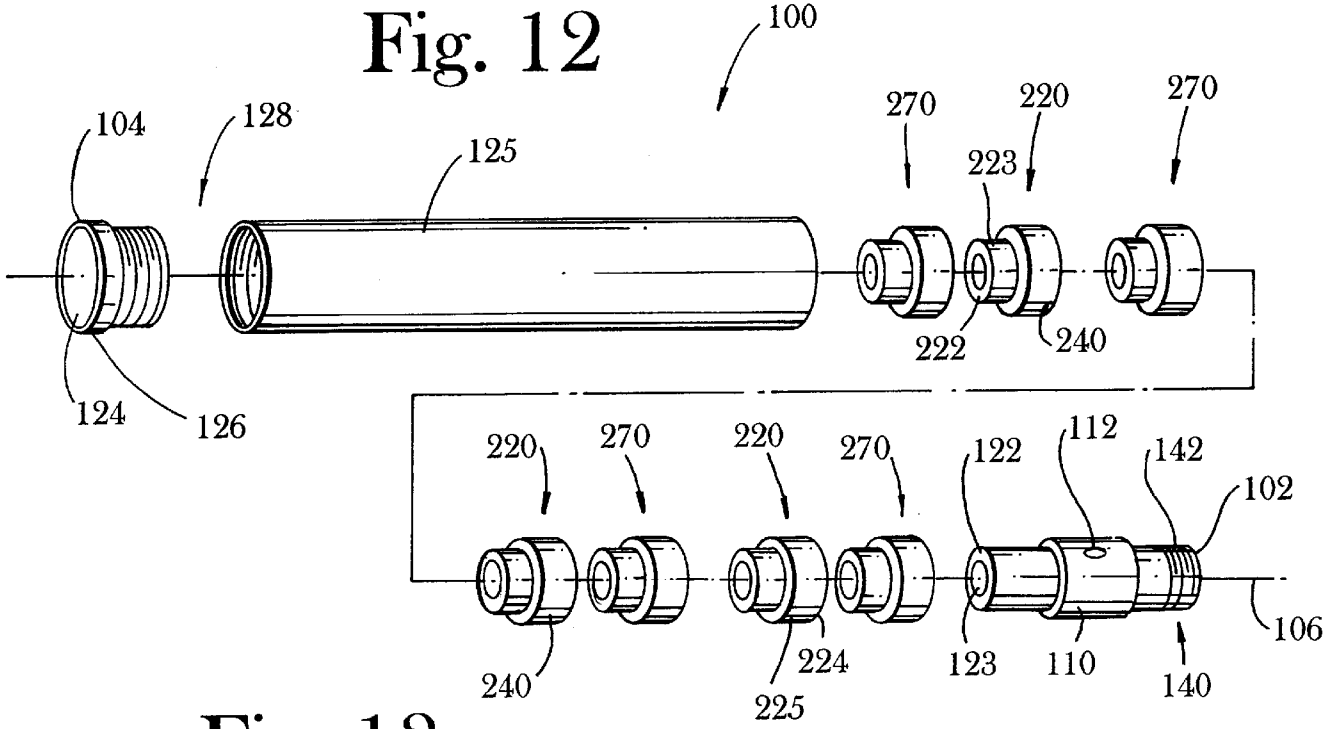
FIG. 12 is an exploded, isometric view of the female connector assembly.
Figure 14:
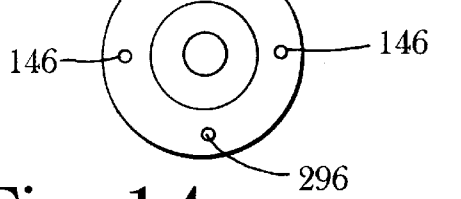
FIG. 14 is a cross sectional view of the female connecting portion taken along line 14—14 of FIG. 3.

As seen in FIGS. 3 and 12, the female connector assembly 100 has a first female end 102, a second female end 104, an axis 106, and a female connector assembly wall 108. At the first female end 102, a female connector attachment means 140 provides releasable attachment of the female connector assembly 100 to a second set of instruments in the wet environment or other equipment positioned in a dry environment like the surface. These instruments and equipment so positioned are hereinafter referred to as second set of wet environment equipment. x In one embodiment, as shown in FIGS. 3 and 12, among many possible designs, the female connector assembly 100 includes exterior cooperative threading 142 constructed to mate with internal threading on the second set of wet environment equipment. Preferably, when used within a well bore, the female connector assembly 100 mounts in the well bore with its second female end 104 relatively near the well bore bottom, and the male connector assembly 20, and its first female end 102 relatively near the surface.

A receiving means 180 in the female connector assembly 100 provides for removable receipt of the nose portion 30 of the male connecting assembly 20. The female connector assembly wall 108 defines an axial female cavity 120 in the female connector assembly 100 that extends from the second female end 104 partially into the female connector assembly 100. The female cavity 120 is sized and constructed to provide for receipt of the nose portion 30 of the male connector assembly 20 into the female connector assembly 100.

As shown in FIGS. 3 and 12, the axial female cavity 120 is defined by, and the female connector assembly 100 includes, (1) an outer sleeve 125, (2) a connecting portion 110, (3) an inner bore 123 in the connecting portion 110, (4) a plurality of alternating female electrical contacts 220 and female insulation members 270, and (5) a retaining sleeve 126. The outer sleeve 125 connects to and extends axially downward from the connecting portion 110 and the plurality of alternating female electrical contacts 220 and female insulation members 270 fit therein in interlocking abutment. To maintain the female electrical contacts 220 and female insulation members 270 in position, the retainer sleeve 126 attaches to the second female end 104. A detailed description of the individual components follows.

The connecting portion 110 is the portion of the female connector assembly 100 which coincides with the first female end 102 and, therefore, includes the female connector attachment means 140 previously described. At the connecting portion 110 end distal to the first female end 102, the connecting portion 110 defines the inner end 122 of the axial female cavity 120. In the preferred embodiment, an inner bore 123 extends axially into the inner end 122 and partially into the connecting portion 110. The inner bore 123 receives the nose cone 42 or other portion of the nose portion 30 that extends beyond the contacts. However, the inner bore 123 may be eliminated by extending the length of the outer sleeve 125.

An evacuation bore 112 comprises a fluid evacuation means 130 that provides fluid communication between a position proximal the inner end 122 of the axial female cavity 120 and the exterior of the female connector assembly 100. In this way, as the nose portion 30 enters the axial female cavity 120, fluid in the axial female cavity 120 is pressed out through the evacuation bore 112 rather than creating and exerting a back pressure on the male connector assembly 20. As shown in the preferred embodiment, the evacuation bore 112 extends from the inner end 122, through the connecting portion 110, at an angle to the axis 106 toward the first female end 102.

The outer sleeve 125 has an annular cross section and extends from the connecting portion 110 towards second female end 104. Preferably, the outer sleeve 125 has a substantially constant inner diameter and outer diameter. The outer diameter is preferably equal to the outer diameter of the connecting portion 110; and the inner diameter is slightly greater than the outer diameter of the female electrical contacts 220 and female insulation members 270 so that they may be inserted therein. At the end of the outer sleeve 125 adjacent second female end 104, a connecting means 128, such as cooperative threading, provides for removable attachment of the retainer sleeve 126 to the outer sleeve 125.

The female electrical contacts 220 are formed of a conductive material such as stainless steel; and the female insulation members 270 are constructed of a nonconductive material, such as a high temperature plastic. However, the female electrical contacts 220 and the female insulation members 270 have similar sizes and relatively similar shapes and are constructed for alternating interlocking attachment. When discussing the similarities between the female electrical contacts 220 and the female insulation members 270, they will hereinafter be referred to generically as female sleeves, 220 and 270. Their differences will be addressed separately.

Referring to FIGS. 3, 5, 6, and 12, the female sleeves, 220 and 270, have a female insertion portion 223 at their female insertion end 222 and a female receiving portion 225 at their female receiving end 224. A female axial cavity 226 extends through the female sleeves, 220 and 270. Both the female insertion portion 223 and the female receiving portion 225 are substantially cylindrical. The outer diameter of the female insertion portion 223 is smaller than the outer diameter of the female receiving portion 225. Further, to facilitate interlocking of the adjacent female sleeves, 220 and 270, the inner diameter of the axial cavity 226 at the female receiving portion 225 is slightly greater than the outer diameter of the female insertion portion 223. Accordingly, the female insertion portion 223 of one female sleeve, 220 and 270, fits in the axial cavity 226 at the female receiving portion 225 of an adjacent female sleeve, 220 and 270, and interlocks therewith. The length of the greater diameter female receiving portion 225 is sufficient to receive the full length of the female insertion portion 223 therein. When positioned in interlocking abutment, the female receiving portions 225 form a continuous, substantially cylindrical outer surface. As mentioned previously, the outer diameter of the female sleeves, 220 and 270, is slightly less than the inner diameter of the outer sleeve 125 to permit their placement therein. Additionally, the female insertion portion 223 includes at least one o-ring groove 12 with an o-ring 14 therein (shown in FIGS. 5 and 6; not shown in FIG. 12). The o-rings 14 mate with the axial cavity 226 at the female receiving portion 225 to provide a seal between adjacent female sleeves, 220 and 270. Preferably, each female insertion portion 223 has two o-ring grooves 12.

When properly positioned, the female sleeves, 220 and 270, slide into the outer sleeve 125. The connecting portion 110 has a reduced diameter at the inner end 122 that is slightly smaller than the inner diameter of the female receiving portion 225. To provide proper sealing and insulation, a female insulation member 270 interlocks with and abuts the reduced diameter portion of the connecting portion 110. A female electrical contact 220 similarly fits into interlocking abutment with the female insertion portion 220 of the previously installed female insulation member 270. Additional, alternating female insulation members 270 and female electrical contacts 220 are then similarly installed. To provide for proper insulation of the female electrical contacts 220 and to provide for their proper alignment with the male electrical contacts 200, a female insulation member 270 must separate the female electrical contacts 220.

Further, to facilitate correct alignment of the contact means 190 the male sleeves, 200 and 250, and the female sleeves, 220 and 270, have substantially similar lengths.

In addition to the features described above and as shown in FIGS. 3 and 5, the female electrical contact body 240 is constructed to hold and maintain the relative longitudinal position of a circular spring 230. Accordingly, the female electrical contact body 240 includes a cylindrical groove 227 in the axial cavity 226 intermediate the female insertion end 222 and the female receiving portion 225. However, the cylindrical groove 227 does not extend to either the female insertion end 222 or the female receiving portion 225 so that retaining lips 228 are formed on either side thereof to facilitate maintenance of the circular spring 230 therein.

The circular springs 230 are constructed such that the centerline of the windings forms a complete circle and are constructed from a conductive material such as beryllium copper or stainless steel. When positioned in the cylindrical groove 227, the circular spring 230 contacts the female electrical contact 220 sufficiently to conduct electrical signals therebetween. Also, when positioned in the cylindrical groove 227 with no male connector assembly 20 positioned in the female connector assembly 100, the inner diameter of the circular spring 230 is slightly less than the outer diameter of the nose portion 30. Accordingly, when the nose portion 30 is inserted in the axial female cavity 120, the circular spring 230 is compressed and exerts a force on the nose portion 30 and the female electrical contact 220. Thus, when properly aligned with the circular spring 230 in contact with its associated male electrical contact 200, the circular spring 230 contacts the both the female electrical contact 220 and the male electrical contact 200 sufficiently to conduct electrical signals therebetween. Such contact is made when the nose portion 30 is functionally inserted in the receiving means 180. Therefore, the contact means 190 comprises the circular spring 230, the female electrical contact 220, and the male electrical contact 200.

Figure 6:
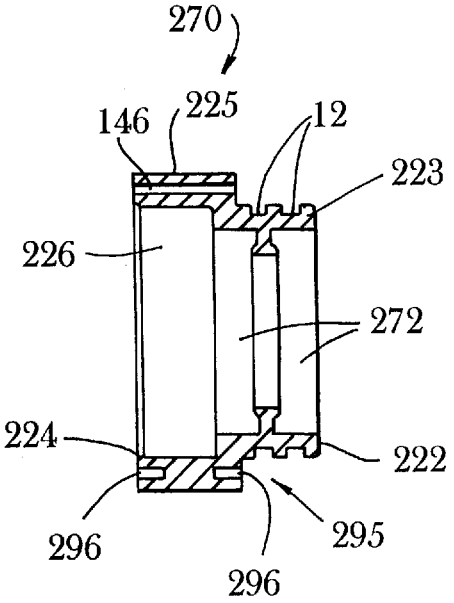
FIG. 6 is a cross sectional view of a female insulation member.
Figure 7:
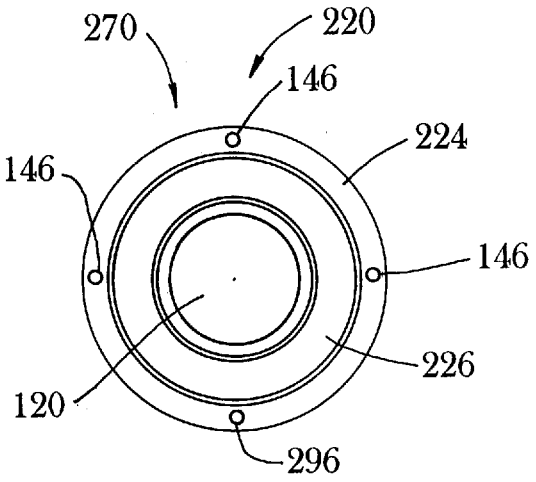
FIG. 7 is an elevational end view of a female electrical contact.
Figure 13:
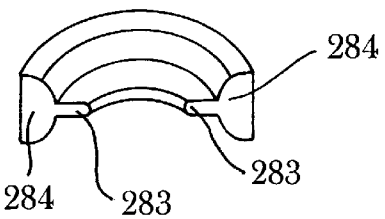
FIG. 13 is an isometric view of a cross section of a ring seal.

Referring to FIGS. 3, 6, and 13, each female insulation member 270 includes at least one seal groove 272, but preferably two, in the axial cavity 226 at the female insertion portion 223. Utilizing two ring seals 282 reduces the risk of failure. The ring seal 282, positioned in each of the seal grooves 272, is constructed of a resilient, nonconductive material such as rubber. As shown in FIG. 13, each ring seal 282 includes a seal body portion 284 and an inward extension portion 283, extending radially inward along the inner circumference of body portion 284. The cross-sectional width of inward extension portion 283 is smaller than the cross-sectional width of body portion 284.

With the inward extension portion 283, the inner diameter of the ring seal 282 is less than the outer diameter of the nose portion 30. Accordingly, when the nose portion 30 is inserted in the axial female cavity 120, the nose portion 30 contacts the inward extension portion 283, the inward extension portion 283 bends, and the ring seal 282 forms a tight seal on the nose portion 30 preventing the flow of fluid therebetween. The female connector assembly 100 and the male connector assembly 20 are constructed such that when the nose portion 30 is functionally inserted in the receiving means 180, the ring seal 282 contacts the associated male insulation member 252. This construction forms a sealing means 280 for sealing fluid proximal each of the contact means 190 from fluid proximal other contact means 190.

Therefore, the male insulation member 252, the female insulation member 270, and the ring seals 282 comprise an insulation means 250 for separating the contact means 190 from one another and for limiting the conductive electrical communication to communication between matching pairs of conductor means, 80 and 150. Because the female electrical contacts 220 and the female insulation members 270 are positioned in alternating, interlocking abutment, no two female electrical contacts 220 are in contact. Thus, they are effectively insulated from one another. Similarly, no two male electrical contacts 200 are in contact; and they, too, are effectively insulated from one another. Further, because each of the female insulation members 270 include ring seals 282 that contact associated male insulation members 252, the fluid adjacent any one contact means 190 is sealed from and does not communicate with the fluid adjacent any other contact means 190. Accordingly, each contact means 190 is effectively insulated from the other contact means 190.

Removably affixed to the end of the outer sleeve 125 adjacent second female end 104, the retainer sleeve 126 has a female sleeve receiver 131 distal second female end 104 and a frustoconical female engagement portion 124 at its other end. Like the female receiving portion 225 of the female sleeves, 220 and 270, to facilitate interlocking of the adjacent female sleeve, 220 and 270, with the retainer sleeve 126 the inner diameter of the axial cavity 226 at the female sleeve receiver 131 is slightly greater than the outer diameter of the female insertion portion 223 of the female sleeves, 220 and 270. Accordingly, the female insertion portion 223 of the adjacent female sleeve, 220 and 270, fits in the axial cavity 226 at the female sleeve receiver 131 of the retainer sleeve 126 and interlocks therewith. The retainer surface 132 of the retainer sleeve 126 distal second female end 104 abuts the adjacent female sleeve, 220 and 270. Preferably, the female sleeve, 220 and 270, adjacent the retainer sleeve 126 is a female insulation member 270 to provide complete insulation and sealing of all the contact means 190.

The portion of the retainer sleeve 126 coinciding with second female end 104 is a frustoconical female engagement portion 124. The inner diameter of the frustoconical female engagement portion 124 increases towards second female end 104 and, thereby, defines a retainer inclined surface 127. At this second female end 104, the female cavity 120, in the frustoconical female engagement portion 124, has a diameter that is only slightly less than the outer diameter of the female connector assembly 100.

In combination, the frustoconical male engagement portion 60, the frustoconical female engagement portion 124, and the nose cone 42 comprise alignment means 320 for facilitating receipt of the nose portion 30 in the female cavity 120 and for providing functional, longitudinal alignment of the female connector assembly 100 relative to the male connector assembly 20. As the female connector assembly 100 and the male connector assembly 20 are moved together into functional receipt, the nose cone 42 first engages the second female end 104. However, because the female cavity 120 at the second female end 104 is only slightly less than the outer diameter of the female connector assembly 100, the nose cone 42 enters the female cavity 120. Both the nose cone 42 and the frustoconical female engagement portion 124 have inclined surfaces, 38 and 127 and, thus, slide over one another. As the male connector assembly 20 is inserted in the female connector assembly 100, the female connector assembly 100 is centered relative to the male connector assembly 20 because the reduction in diameter of the frustoconical female engagement portion 124 moves the nose portion 30 thereto.

As the two assemblies 20 and 100 move further together into functional receipt, the female connector assembly 100 receives the nose portion 30 into the female cavity 120; and the female connector assembly 100 and the male connector assembly 20 are coaxially aligned. The multiple contact wet connector 10 is constructed such that, when the frustoconical female engagement portion 124 engages the frustoconical male engagement portion 60, the contact means 190 and the insulation means 250 are properly, functionally aligned. The frustoconical female engagement portion 124 and the frustoconical male engagement portion 60 have substantially similar inclination angles; and, when the parts are engaged, they prevent further relative longitudinal movement of the female connector assembly 100 and the male connector assembly 20.

As shown in FIGS. 3, 5, 6, 7, and 14, each of the female sleeves, 220 and 270, and the connecting portion 110 include a plurality of female wiring passageways 146 that extend parallel to the axis of the female connector assembly 100. The female wiring passageways 146 are positioned so that, when the female connector assembly 100 is assembled, the female wiring passageways 146 are aligned. Each of the female wiring passageways 146 is sized to permit the placement of a female conductor means 150 therethrough. Preferably, the number of wiring passageways 146 equals the number of female electrical contacts 220 in the female connector assembly 100.

Figure 10:
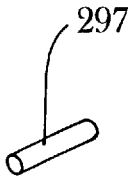
FIG. 10 is an isometric view of a female alignment pin.

As shown in FIGS. 3, 5, 6, 7, and 14, a separate female alignment passageway 296 extends parallel to the axis of the female connector assembly 100 through each of the female sleeves, 220 and 270, and the connecting portion 110. When the female connector assembly 100 is assembled, the female alignment passageways 296 in the individual parts are aligned. One or more female alignment pins 297 (as shown in FIG. 10) are sized and constructed to fit into the female alignment passageway 296 so that, when inserted, the female alignment pins 297 prevent the relative rotation of the female sleeves, 220 and 270, and the connecting portion 110. Consequently, the female alignment passageways 296 and the female alignment pins 297 comprise a female sleeve alignment means 295. Alternatively, the female sleeve alignment means 295 may comprise a plurality of coaxial female alignment passageways 296 wherein each female alignment passageway 296 extends partly into each of the adjacent male sleeves, 220 and 270. The length of each such female alignment passageway 296 is sufficient to receive a single female alignment pin 297 therein. Many possible designs for female sleeve alignment means 295 are anticipated. However, the female sleeve alignment means 295 described is preferred.

Within the female connecting assembly 100, a plurality of female conductor means 150 provide conductive electrical communication through the female connector assembly 100. The number of female conductor means 150 preferably corresponds to the number of female electrical contacts 200 and to the number required for the pertinent application. Each female conductor means 150 connects to a separate female electrical contact 220 and extends from that contact, through its associated wiring passageway 146, to connecting portion 110. Each female conductor means 150 extends through a separate wiring passageway 146. Preferably, the female conductor means 150 is an insulated elongated member 152 constructed of a conductive material such as a high temperature wire or contact pins.

At the end of the female conductor means 150 distal the female electrical contact 220, the female attachment end 151, a female conductor attachment means (not shown in Figures) provides for releasable attachment of and conductive communication between the female conductor means 150 and the second set of wet environment equipment conductor means (not shown in Figures). The configuration and shape of the female conductor attachment means may take many forms and will depend on the equipment to which the female conductor means is attached. One example, shown in the figures, is simply a cylindrical body, having an axial wire receiving bore therein, in electrical communication with the female attachment end 151. The end of the second set of wet environment equipment conductor means would simply slide into the axial wire receiving bore and make conductive contact therewith. As shown in the figures, the connecting portion 110 may include a recessed portion 111 to provide protection for the female conductor attachment means.

Each of the male conductor means 80 corresponds to separate matching female conductor means 150 to form a matching pair of conductor means 170. As described, each of the conductor means, 80 and 150, is associated with a specific contact, 200 and 220. When functionally positioned, each male electrical contact 200 contacts a predetermined female electrical contact 220. The predetermined longitudinal position of each of the contacts, 200 and 220, makes possible the matching of the male conductor means 80 to an female conductor means 150. Consequently, a signal may be transmitted through each matching pair of conductor means 170; and a plurality of signals may be simultaneously transmitted through the multiple contact wet connector 10.

Because of the removable, interlocking design of the sleeves, 200, 220, 252, and 270, the number of contact means, 190, as well as the length of the multiple contact wet connector 10 is easily changed. Likewise, the multiple contact wet connector 10 is easily repaired.

Other o-rings 14 between the various parts, as shown in the figures, provide a seal between the related, mating parts.

Figure 15:
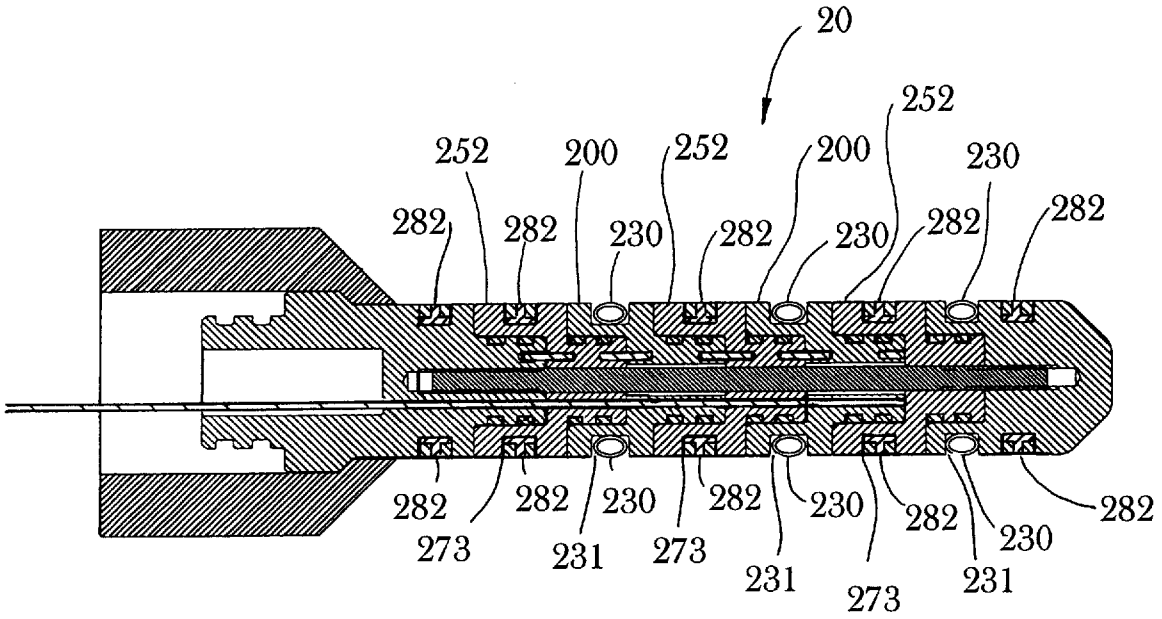
FIG. 15 is a cross sectional view of an alternative embodiment of the male connector assembly.
Figure 18:
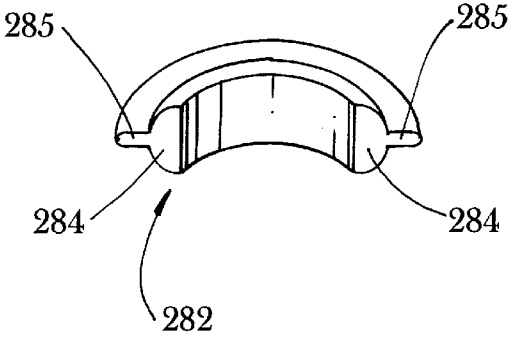
FIG. 18 is an isometric view of a cross-section of a ring seal in an alternative embodiment.
Figure 19:
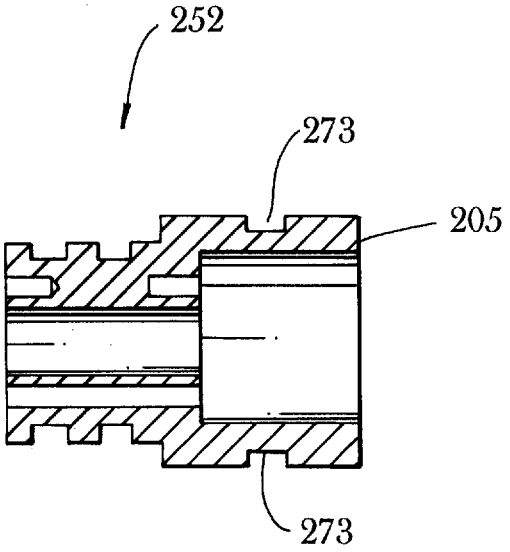
FIG. 19 is a cross sectional view of a male insulation member in an alternative embodiment.

In an alternative embodiment as generally shown in FIGS. 15–21, the circular springs 230 are held by the male electrical contact 200 (instead of the female electrical contact 240) and the ring seals 282 are held by male insulation member 252 (instead of the female insulation member 270). Thus, in the alternative embodiment, as shown in FIGS. 15 and 19, in order to accommodate rings seal 282, each male insulation member 252 includes one sealing groove 273, but preferably two, along the outer circumference of its male receiving portion 205. Sealing groove 273 holds ring seal 282. With the noted exceptions, the multiple contact wet connector 10 in the alternative embodiment is constructed, functions, and is assembled in the same manner as in the previous embodiment.

However, the shape of the ring seals 282 as used in the alternative embodiment is different from that used in the previous embodiment. As shown in FIG. 18, each ring seal 282 includes a seal body 284 and an outward extension portion 285, extending radially outward along the outer circumference of body portion 284. The cross-sectional width of outward extension portion 285 is smaller than the cross-sectional width of body portion 284.

With the outward extension portion 285, the outer diameter of the ring seal 282 is less than the outer diameter of the nose portion 30. Accordingly, when the nose portion 30 is inserted in the female axial cavity 120, the outward extension portion 285 contacts the surfaces of female insulation member 270, the outward extension portion 285 bends, and the ring seal 282 forms a tight seal on the female insulation member 270 preventing the flow of fluid therebetween.

Figure 20:
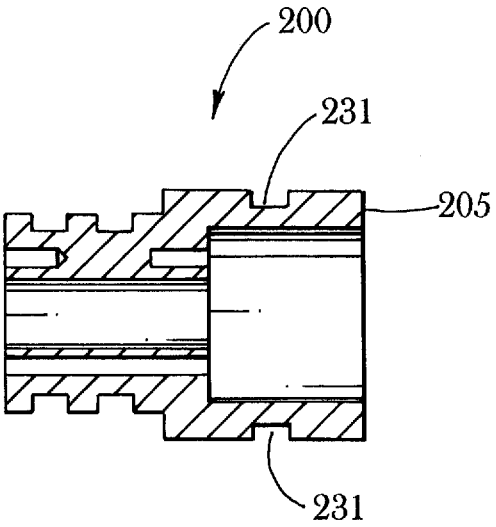
FIG. 20 is a cross sectional view of a male contact member in an alternative embodiment.

As shown in FIGS. 15 and 20, in the alternative embodiment, in order to accommodate circular springs 230, each male electrical contact 200, at the outer circumference of the male receiving portion 205, includes a contact groove 231 which holds circular spring 230 and maintains it in a longitudinal position. When positioned in the contact groove 231, the circular spring 230 contacts the male electrical contact 200 sufficiently to conduct electrical signals therebetween. Also, when positioned in the contact groove 231 with no male connector assembly 20 positioned in the female connector assembly 100, the outer diameter of the circular spring 230 is slightly more than the outer diameter of the nose portion 30 and slightly less than the inner diameter of female insertion portion 223. Accordingly, when the nose portion 30 is inserted in the axial female cavity 120, the circular spring 230 is compressed and exerts a force on the nose portion 30 and the female electrical contact 220. Thus, when properly aligned with the circular spring 230 in contact with its associated female electrical contact 220, the circular spring 230 contacts the female electrical contact 220 and the male electrical 200 sufficiently to conduct electrical signals therebetween. Such contact is made when the nose portion 30 is functionally inserted in the receiving means 180.

Figure 16:
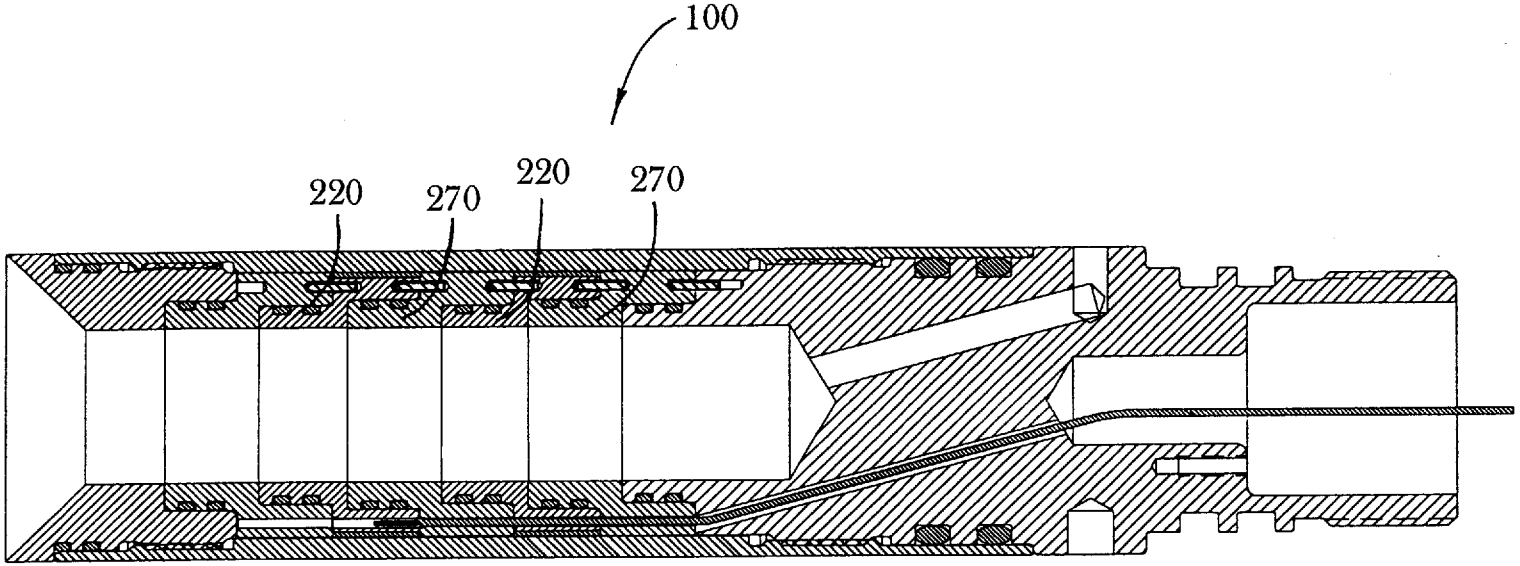
FIG. 16 is a cross sectional view of an alternative embodiment of the female connector assembly.
Figure 17:
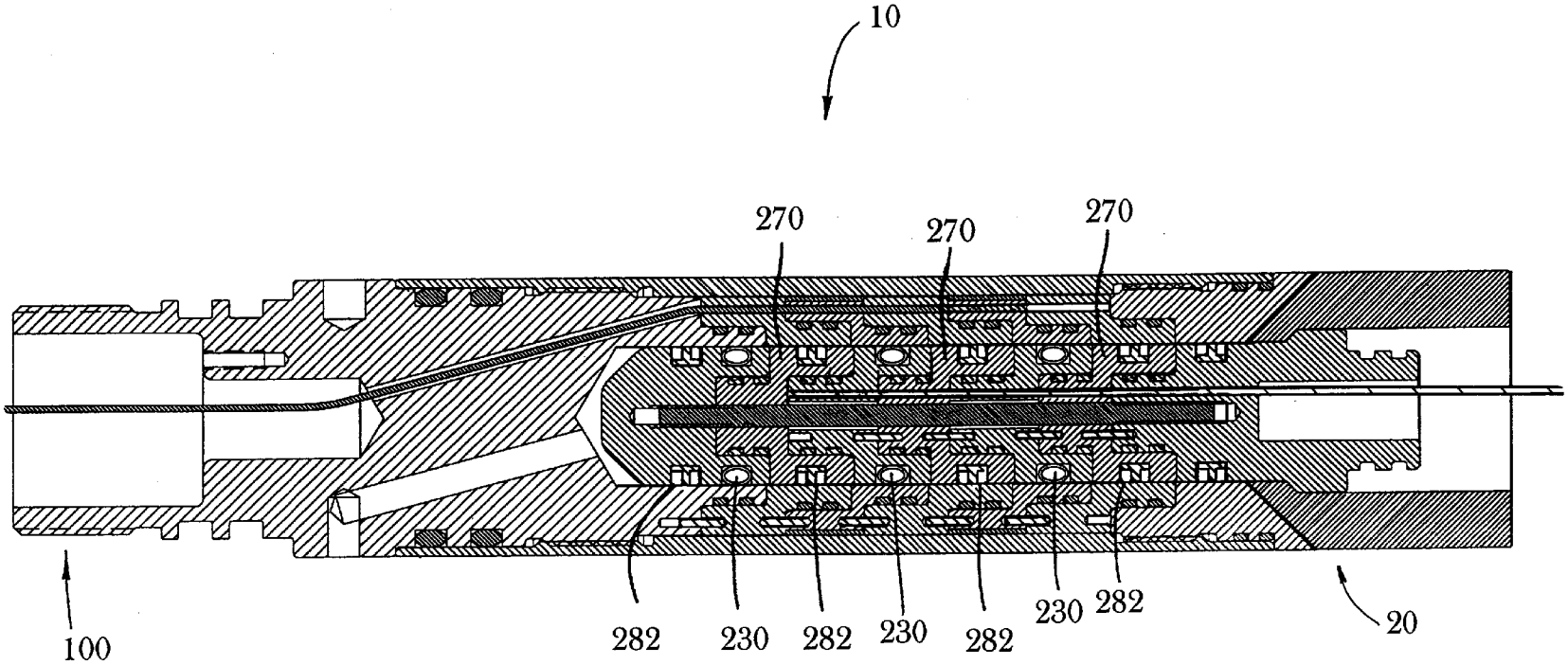
FIG. 17 is a cross sectional view of an alternative embodiment of the multiple contact wet connector.
Figure 21:
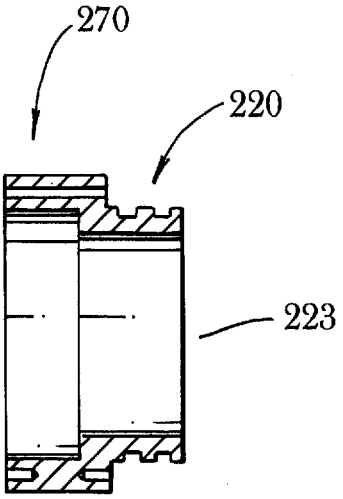
FIG. 21 is a cross sectional view of a female sleeve in an alternative embodiment

In the alternative embodiment, as shown in FIGS. 16 and 21, the female sleeves, 220 and 270, are substantially similar in shape, no longer necessitating cylindrical groove 227 (for circular spring 230 now held by male contact member 200) or seal groove 272 (for seal ring 282 now held by male insulation member 252).

Although the invention has been described primarily in the preferred embodiment, many design modifications could be made without departing from the spirit and scope of the invention. For example, either the male connector assembly 20 or the female connector assembly 100 may be closer to the dry environment, or, in other words, face the surface. These orientations could easily be changed and are considered as part of the present invention. Likewise, the circular springs 230 in the contact means 190 could be omitted or replaced with other types of springs or resilient pieces that ensure proper electrical contact. Further, the conductive portions of the contacts, 200 and 220, are shown herein as circular. This could be altered to have one circular contact and one contact that is merely a strip of conductive material or a conductive detent. Additionally, the interlocking arrangement of the sleeves, 200, 220, 252, and 270, and their alignment means, 290 and 295, may be easily redesigned to obtain the same results. It is also understood that the male and female conductor means, 80 and 150, include any type of suitable conductor means, including contact pins. And it is further understood that instead of being composed of separate, modular sleeves, 200, 220, 252, and 270, and other parts, the male connector assembly 20 and the female connector assembly 100 may each be constructed of one integral part, such as by injection molding. And, it is further understood that instead of being composed of separate, modular sleeves, 200, 220, 252, and 270, and other parts, the male connector assembly 20 and the female connector assembly 100 may each be constructed of one integral part, such as by injection molding.

I claim:

1. A multiple contact wet connector for connection of electrical or communication lines in a fluid-filled wet environment comprising:

a male connector assembly having a nose portion;

a female connector assembly;

said female connector assembly having a female connector assembly wall;

said female connector assembly wall defining a female cavity in said female connector assembly;

a fluid evacuation bore for providing fluid communication from said female cavity to a position exterior of said female connector assembly;

receiving means in said female connector assembly for removably receiving said nose portion;

a plurality of male conductor means for providing conductive electrical communication through said male connector assembly;

a plurality of female conductor means for providing conductive electrical communication through said female connector assembly; each of said plurality of male conductor means corresponding to a separate, matching one of said plurality of female conductor means to form a plurality of matching pairs of conductor means;

a plurality of contact means for providing electrical conductive contact between said plurality of matching pairs of conductor means when said nose portion is functionally inserted in said receiving means;

said plurality of contact means operable while in direct contact with said fluid filled wet environment;

insulation means for separating said plurality of contact means; and said insulation means prohibiting flow of said fluids between matching pairs of conductor means thereby limiting said conductive electrical communication to communication between said plurality of matching pairs of conductor means.

2. A multiple contact wet connector as claimed in claim 1 wherein:

said nose portion having a first nose end and a second nose end;

an elongated, substantially cylindrical central nose portion of said nose portion;

a conical portion at said second nose end having a conical portion diameter that increases from said second nose end to said central nose portion; and said conical portion diameter maximum diameter equalling the diameter of said cylindrical central nose portion.

3. A multiple contact wet connector as claimed in claim 1 further comprising:

a male connector attachment means for connecting said male connector assembly to a first set of wet environment equipment; and a female connector attachment means for connecting said female connector assembly to a second set of wet environment equipment.

4. A multiple contact wet connector as claimed in claim 4 wherein:

said male connector attachment means is cooperative threading; and said female connector attachment means is cooperative threading.

5. A multiple contact wet connector as claimed in claim 1 wherein said receiving means comprises:

said female connector having a first female end, a second female end, and an axis;

said female cavity being axially aligned with said female connector axis;

said female cavity extending from said second female end partially through said female connector assembly; and said female cavity sized and constructed to receive said nose portion.

6. A multiple contact wet connector as claimed in claim 5 further comprising:

said female cavity having an inner end;

said fluid evacuation bore providing fluid communication from said female cavity proximal said inner end to a position exterior of said female connector assembly.

7. A multiple contact wet connector as claimed in claim 5 further comprising alignment means for facilitating receipt of said nose portion in said female cavity and providing functional longitudinal alignment of said female connector assembly relative to said male connector assembly.

8. A multiple contact wet connector as claimed in claim 7 wherein said alignment means comprises:

said male connector assembly having a first male end and a second male end;

a male connecting portion of said male assembly proximal said second male end;

said nose portion extending from said male connecting portion to said first male end;

a frustoconical male engagement portion of said male connecting portion having its larger diameter proximal said second male end and its smaller diameter distal said second male end;

a frustoconical female engagement portion of said female cavity proximal said second female end;

said frustoconical female engagement portion having its larger diameter proximal said second female end and its smaller diameter distal said second female end;

so that, as said female connector assembly is lowered onto said male connector assembly, said nose portion engages said frustoconical female engagement portion and slides along its surface into coaxial alignment therewith; and so that, upon engagement of said frustoconical female engagement portion with said frustoconical male engagement portion, said plurality of contact means are functionally aligned.

9. A multiple contact wet connector as claimed in claim 1 wherein each of said plurality of female conductor means comprises an insulated elongated member constructed of conductive material.

10. A multiple contact wet connector as claimed in claim 1 wherein each of said plurality of male conductor means comprises an insulated elongated member constructed of conductive material.

11. A multiple contact wet connector as claimed in claim 1 wherein each of said plurality of contact means comprises:

a male electrical contact positioned in said nose portion; and a female electrical contact positioned in said receiving means.

12. A multiple contact wet connector as claimed in claim 11 wherein said female electrical contact comprises:

a circular spring constructed of conductive material; and a female electrical contact body constructed to hold and maintain the relative longitudinal position of said circular spring.

13. A multiple contact wet connector as claimed in claim 11 wherein said male electrical contact comprises:

a circular spring constructed of conductive material; and a male receiving portion constructed to hold and maintain the relative longitudinal position of said circular spring along the outer most circumference of said male electrical contact.

14. A multiple contact wet connector as claimed in claim 1 wherein said insulation means comprises:

a male insulation member positioned in said nose portion between each of said plurality of contact means;

said male insulation member constructed from a substantially nonconductive material;

a female insulation member positioned in said receiving means between each of said plurality of contact means;

said female insulation member constructed from a substantially nonconductive material; and sealing means for sealing fluid proximal each of said plurality of contact means from fluid proximal other contact means of said plurality of contact means.

15. A multiple contact wet connector as claimed in claim 14 wherein each of said plurality of contact means comprises:

a male electrical contact positioned in said nose portion; and a female electrical contact positioned in said receiving means.

16. A multiple contact wet connector as claimed in claim 15 wherein said male electrical contact and said male insulation member constructed for alternating, interlocking attachment.

17. A multiple contact wet connector as claimed in claim 16 wherein said male electrical contact and said male insulation member have a substantially similar size and shape.

18. A multiple contact wet connector as claimed in claim 15 wherein said female electrical contact and said female insulation member constructed for alternating, interlocking attachment.

19. A multiple contact wet connector as claimed in claim 15 wherein said male electrical contact and said female electrical contact are in conductive abutment when said nose portion is functionally inserted in said receiving means.

20. A multiple contact wet connector as claimed in claim 15 wherein said sealing means comprises:

at least one ring seal held and longitudinally maintained by each of said female insulation members; and said at least one ring seal positioned and constructed to engage said male insulation member when said nose portion is functionally inserted in said receiving means.

21. A multiple contact wet connector as claimed in claim 15 wherein said sealing means comprises:

at least one ring seal held and longitudinally maintained by each of said male insulation members; and said at least one ring seal positioned and constructed to engage said female insulation member when said nose portion is functionally inserted in said receiving means.

22. A multiple contact wet connector as claimed in claim 20 wherein said sealing means comprises two of said at least one ring seals in each of said female insulation members.

23. A multiple contact wet connector as claimed in claim 21 wherein said sealing means comprises two of said at least one ring seals in each of said male insulation members.

24. A multiple contact wet connector as claimed in claim 20 wherein:

said at least one ring seals includes a body portion and an inward extension portion;

said inward extension portion extending radially inward along the inner circumference of said body portion;

the cross-sectional width of said inward extension portion being relatively smaller than the cross-sectional width of said body portion; and said inward extension portion constructed of a resilient material.

25. A multiple contact wet connector as claimed in claim 21 wherein:

said at least one ring seals includes a body portion and an outward extension portion;

said outward extension portion extending radially outward along the outer circumference of said body portion;

the cross-sectional width of said outward extension portion being relatively smaller than the cross-sectional width of said body portion; and said outward extension portion constructed of a resilient material.

26. A multiple contact wet connector as claimed in claim 1 comprising three contact means.

* * * * *